US005124612A

United States Patent [19]

Takamura et al.

[11] Patent Number: 5,124,612

[45] Date of Patent: Jun. 23, 1992

[54] SPARK PLUG FOR INTERNAL-COMBUSTION ENGINE

[75] Inventors: Kozo Takamura, Nagoya; Hiroyuki Murai, Anjo; Yasuyuki Sato, Kasugai, all of Japan

[73] Assignee: Nippondenso Co., Ltd., Kariya, Japan

[21] Appl. No.: 605,001

[22] Filed: Oct. 30, 1990

Related U.S. Application Data

[63] Continuation of Ser. No. 368,763, Jun. 20, 1989, abandoned, which is a continuation of Ser. No. 182,154, Apr. 15, 1988, Pat. No. 4,845,400.

[30] Foreign Application Priority Data

Apr. 16, 1987 [JP] Japan ..... 62-94053

[51] Int. Cl.[5] ..... H01T 13/20; H01T 13/52

[52] U.S. Cl. ..... 313/141; 313/143

[58] Field of Search ..... 313/141, 142, 143

[56] References Cited

U.S. PATENT DOCUMENTS

| | | | |
|---|---|---|---|
| 3,517,247 | 6/1970 | Szilagyi | 313/143 X |
| 4,211,952 | 7/1980 | Iwata et al. | 313/143 |
| 4,700,103 | 10/1987 | Yamaguchi et al. | 313/141 |
| 4,845,400 | 7/1989 | Takamura et al. | 313/141 X |

*Primary Examiner*—Sandra L. O'Shea

*Attorney, Agent, or Firm*—Cushman, Darby & Cushman

[57] ABSTRACT

A spark plug for an automotive internal combustion engine providing improved ignition even when carbon is deposited on the insulator of the plug. A rich fuel-air ratio causes carbon to be deposited on spark plug insulators, thereby decreasing its effective insulation. By limiting the geometrical dimension of the plug's center electrode, ground electrode, and insulator the problem of carbon build-up is overcome. The sizes of these elements have certain allowable ranges that enhance the igniting effect of the plug.

7 Claims, 16 Drawing Sheets

(a)

(b)

SPARK PLUG FOR INTERNAL-COMBUSTION ENGINE

This is a continuation of application Ser. No. 07/368,763 now abandoned, filed on Jun. 20, 1989, which was abandoned upon the filing hereof which is a Rule 60 CONT of Ser. No. 07/182,154 filed Apr. 15, 1988 now U.S. Pat. No. 4,845,400 issued Jul. 4, 1989.

FIELD OF THE INVENTION

The present invention relates to a spark plug for an automotive internal combustion engine.

BACKGROUND OF THE INVENTION

A spark plug used for an automotive internal combustion engine employs a center electrode and a ground electrode for generating the spark there-between.

The rich air fuel mixture is supplied to the automotive internal combustional engine, in order to improve the driving condition under the low temperature atmosphere, so that carbon which is not a conductive material may deposit on a surface of a insulator which insulates the center electrode from the ground electrode. As to the present inventors' experiment, it is observed that the carbon is deposited on the insulator during the beginning stage of the operation of the engine, namely during the transferring stage while the automotive is transferred from the automotive manufactory to the user. The carbon deposited on the insulator reduces the insulating effect so that the carbon reduces the life length of the spark plug.

In order to prevent the disadvantage caused by the carbon, the conventional type of spark plug(Japan Patent 56-51476) has employed the center electrode the top portion of which is narrower than the other parts so that a ring shaped space is formed between the top portion of the center electrode and the insulator, and the top end of the center electrode is withdrawn from the top surface of the insulator The conventional type of spark plug(Japan patent 56-51476) has employed the ground electrode, the side surface of which is provided close to the insulator in such a manner that a gap between the side surface of the ground electrode and the top end of the insulator is narrower than a gap between a top end portion of the center electrode and the side surface of the ground electrode. A spark is generated at the first gap between the center electrode and the ground electrode when the carbon is not deposited on the top surface of the insulator. The spark then generates at the second gap between the insulator and the ground electrode when the carbon is deposited within the ring shaped space in order to burn out the carbon deposited within the ring shaped space.

Another type of conventional spark plug(Japan patent 58-40831) has employed the center electrode, the top portion of the center electrode being narrower than the remaining portion so that the ring shaped space is formed between the outer surface of the top portion of the center electrode and the inner surface of the insulator, the top end of which is extruded from the top surface of the insulator. The ground electrode of the conventional type of spark plug(Japan patent 58-40831) faces toward the side surface of the top portion of the center electrode which is extruded from the insulator in such a manner that a first gap is formed between the top end of the ground electrode and the side surface of the center electrode. A second gap which is smaller than the first gap is formed between the top surface of the insulator and the side surface of the ground electrode of the conventional spark plug. The spark is generated at the first gap while the carbon is not deposited on the top surface of the insulator, and the spark is generated at the second gap when the carbon is deposited within the ring shaped space including the top portion of the insulator. The spark generated at the second gap burns out the carbon deposited within the ring shaped space.

These conventional types of spark plugs, however, have disadvantages described hereinafter. Since the top end of the center electrode of the former spark plug, (Japan patent 56-51476), is withdrawn into the inner portion of the insulator, the spark generated at the first gap should contact with the inner surface of the insulator while the core of the flare grows, so that the growth of the core of the .flare is hindered by the inner surface of the insulator. Accordingly, the former type of the conventional spark plug cannot ignite effectively. Furthermore, since the second gap is narrower than the first gap of the former type of conventional spark plug(Japan patent 56-51476), the core of the flare cannot grow at the second gap even when the spark is generated at the second gap under the condition that the carbon is deposited within the ring shaped space. The conventional spark plug, therefore, cannot ignite effectively.

Since the first gap of the latter type of the conventional spark plug (Japan patent 58-40831) is formed at the side surface of the top portion of the center electrode which is extruded from the insulator, the core of the flare at the first gap can grow more smoothly than that of the former type of the conventional spark plug. However, since the second gap of the latter type of the conventional spark plug is positioned behind of the first gap, the core of the flare generated at the second gap is hard to be contacted with the air-fuel mixture. Furthermore since the second gap is narrower than the first gap, the core of the flare generated at the second gap cannot grow widely so that the core of the flare generated at the second gap cannot ignite the air-fuel mixture effectively.

Accordingly, the disadvantage that the growth of the core of the flare generated at the first gap is hindered by the contact with the inner surface of the insulator such as caused in the former type of the conventional spark plug is solved by extruding the top end of the center electrode from the top end of the insulator such as described in the latter type of spark plug.

However, since the second gap of both types of the conventional spark plug is narrower than the first gap, the disadvantage that the second gap at which the spark is generated when the carbon is deposited within the ring shaped space cannot attain the effective igniting.

SUMMARY OF THE INVENTION

The present invention has an object to improve the igniting effect even when the carbon is deposited on the In order to attain this object, the spark plug of the present invention employs the limitations to the geometrical dimensions of the center electrode, the ground electrode and the insulator, as the following formulas;

$$0.2\ \text{mm} \leqq l \leqq 0.7\ \text{mm}$$

$$0.35\ \text{mm} \leqq S \leqq 1.0\ \text{mm}$$

$$0.1\ \text{mm} \leqq L \leqq 1.0\ \text{mm}$$

$0.5mm \leqq G \leqq 1.5$ mm wherein l represents the distance between the top end of the center electrode and the top surface of the S represents the distance between the side surface of the center electrode and the inner surface of the L represents the depth of the ring shaped space formed inner side of the insulator, and G represents the gap between the top end of the center electrode and the side surface of the ground electrode to which the center electrode faces.

The relationship of the geometrical dimensions of the insulator and the ground electrode is preferred as in the following formula;

$$E \leqq 0.8\ D$$

wherein D represents the inner diameter of the inner hole of the insulator, and

E represents the width of the ground electrode.

The spark plug of the present invention employs an annular electrode formed on the inner surface of the housing in such a manner that the annular electrode surrounds the insulator while keeping a predetermined gap a therebetween. The width of the gap a is preferred between 0.5 mm–1.3 mm.

Since the spark plug of the present invention employs the geometrical dimension described above, the spark plug of the present invention can improve the igniting effect. The igniting operation of the spark plug is explained referring to FIGS. 3(*a*) and 3(*b*). FIG. 3(*a*) shows the capacitor discharge caused at the top surface of the insulator, FIG. 3(*b*) shows the capacitor discharge caused at the top end of the center electrode. The spark generated by the spark plug is classified with the capacitor discharge which makes the ionized zone around the spark and the inductor discharge which is caused along with the ionized zone.

The solid lines described in FIGS. 3(*a*) and 3(*b*) represents the capacitor discharge, and the hatched portion in FIGS. 3(*a*) and 3(*b*) represents the ionized zone. The inductor discharge is generated at the spot where the atmosphere is most ionized within the ionized zone. The present inventors had observed the operation of the spark plug such as described in FIGS. 3(*a*) and 3(*b*) by using the internal combustion engine having a glass through which the inner side of the cylinder could be observed.

Since carbon is also deposited on the inner surface of the insulator when the carbon is deposited on the top surface of the insulator, the electric potential at the top portion of the center electrode and that at the top surface of the insulator should be at the same level when high voltage is supplied to the center electrode. Accordingly, the capacitor discharge can be generated either at the top surface of the insulator (shown in FIG. 3(*a*)) and at the top end of the center electrode (shown in FIG. 3(*b*)) when the carbon deposited to the insulator. As to the condition that the spark is generated at the top surface of the insulator (FIG. 3(*a*)), the capacitor discharge is generated between the edge point x and the side surface of the ground electrode. Since the gap g between the edge point x and the ground electrode is longer than the gap G between the center electrode and the ground electrode, the area of the ionized zone by the gap g should be larger than that by the gap G. Not only the gap g but also the ring shaped space becomes ionized due to the capacitor discharge and the inductor discharge, the energy of which is higher than that of capacitor discharge, which occurred within the ring shaped space 10. The inductor discharge generated in the ring shaped space 10 burns out the carbon deposited on the inner surface of the insulator.

As to the condition that the spark occurs at the top end of the center electrode (FIG. 3(*b*)), the capacitor discharge is generated at the edge point of the top end of the center electrode and the inner side surface of the ground electrode so that the capacitor discharge is generated at the gap G. Since the capacitor discharge is occurs at the portion where the atmosphere is ionized most strongly and since the condition of the atmosphere of the spark plug is varied, the portion at which the capacitor discharge is generated is varied frequently. The capacitor discharge is generated at the gap G when the atmosphere at the gap G is ionized stronger than the other parts, and the capacitor discharge is generated at the gap 9 when the atmosphere at the gap g is ionized stronger than other portions. Since the atmosphere within the ring shaped space 10 is ionized even when the capacitor discharge is generated at the top end of the center electrode (FIG. 3(*b*)), the inductor discharge is generated at the ring shaped space 10 and the gap g and such the inductor discharge makes the carbon deposited on the inner surface of the insulator burn out. As described above, the inductor discharge is generated either at the gap G, at the ring shaped space 10 and at the gap g even when the carbon is not deposited on the inner surface of the insulator because the inductor discharge is generated so many times during the operation of the internal combustion engine, the carbon deposited on the inner surface of the insulator can be easily burned out by the inductor discharge.

The spark plug having a second ring shaped space between the top portion of the center electrode and the inner surface of the insulator can expand the ionized zone, so that the spark plug having the first ring shaped space and the second ring shaped space can burn the carbon deposit on the inner surface of the insulator out more effectively.

BRIEF DESCRIPTION OF THE DRAWING

FIG. 1(*b*) is a sectional view of a part of the spark plug,

DETAILED DESCRIPTION OF THE PREFERRED EMBODIMENT

Figure 1:
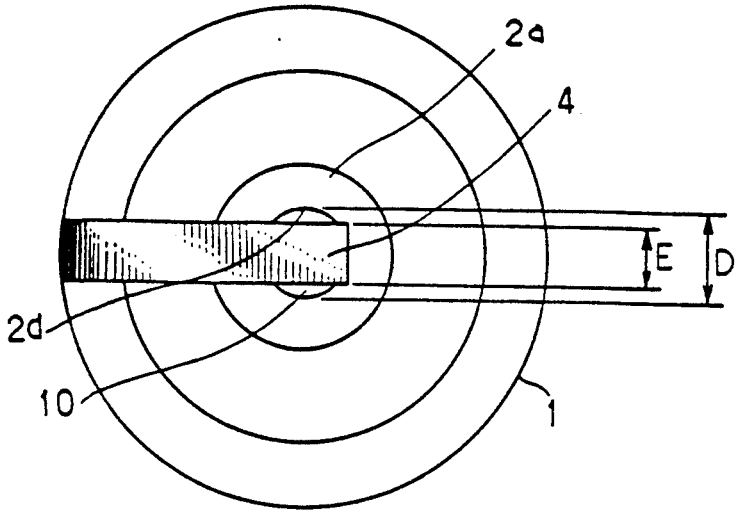
FIG. 1(*a*) is a top view of the spark plug of the present invention.
Figure 1:
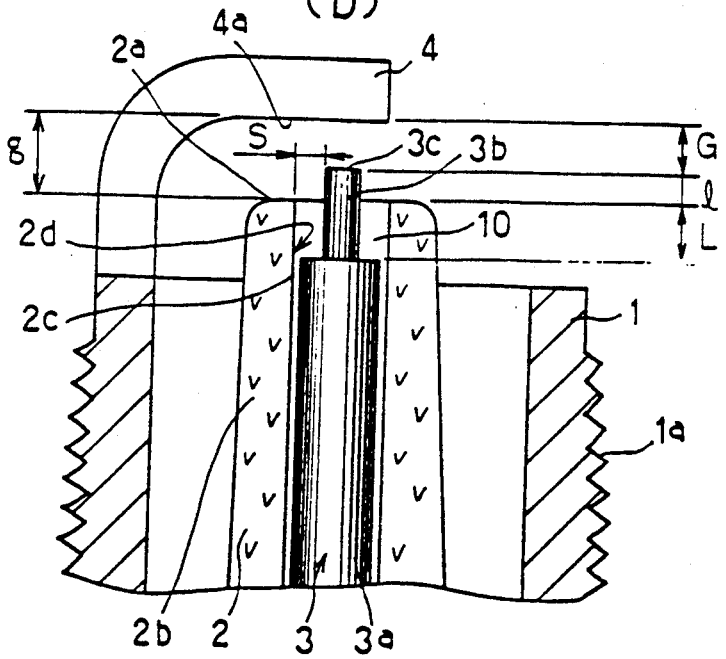
Figure 2:
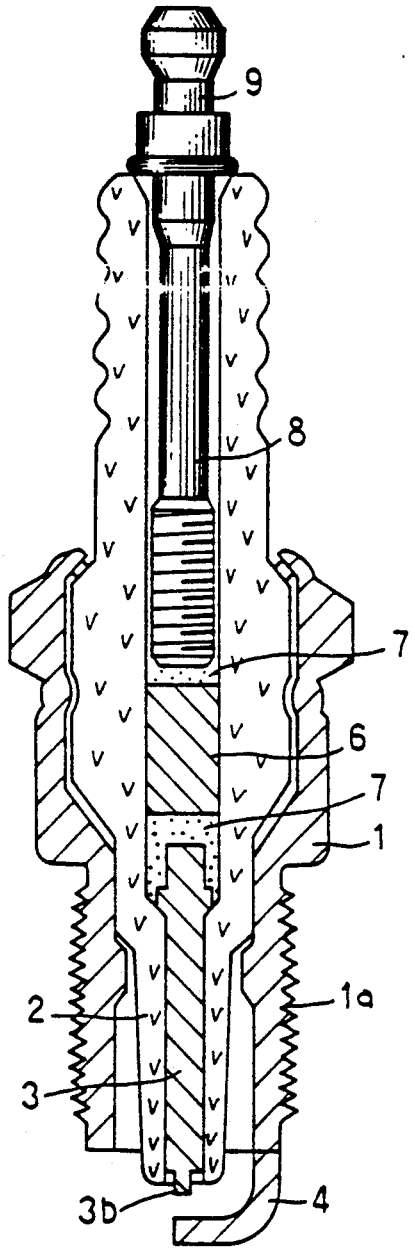
FIG. 2 is a sectional view of the spark plug shown in FIG. 1(*b*)
Figure 3:
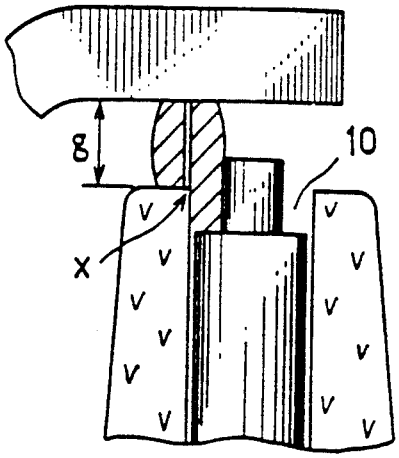
FIGS. 3(*a*) and 3(*b*) are sectional views of the spark plug showing the capacitor discharge and the inductor discharge.
Figure 3:
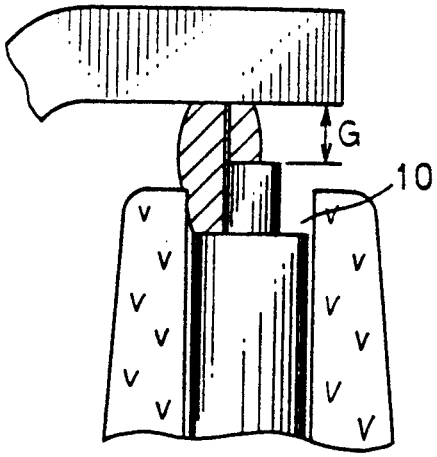

As shown in FIGS. 1(*a*), 1(*b*) and 2, a ground electrode 4 is connected to a housing 1 which is made of metal, and is provided at an outer surface of an insulator 2. The insulator 2 has an elongated inner hole 2*c* along the axial line of the insulator 2, the inner hole 2*c* is opened at the top surface 2*a* of the insulator 2. A center electrode 3 is provided within the inner hole 2*c* at a cylinder portion 2*b* of the insulator 2. The diameter of the center electrode 3 at a top portion 3*b* is smaller than that at an electrode body 3*a*. The top end 3*c* of the top portion 3*b* is extruded from the top surface 2*a* of the insulator 2. The connecting position of the top portion 3*b* and the electrode body 3*a* is positioned within the inner hole 2*c*. A ring shaped space 10 is formed between an outer surface of the top portion 3*b* and an inner surface 2*d* of the inner hole 2*c* and the ring shaped space 10 is opened to the top surface 2*a* of the insulator 2. A gap G is formed between the top end 3*c* of the top portion 3*b* and the side surface 3*a* of the ground electrode 4. A gap g is also formed between the top surface 2*a* of the insulator 2 and the side surface 4*a* of the ground electrode 4. The gaps G and g are so formed that the gap g is greater than the gap G.

The reference numeral 1*a* shows a thread portion formed on the outer surface of the housing 1, the numeral 6 shows a resistor for protecting the radio wave noise, the numeral 7 shows a glass layer, the numeral 8 shows a center shaft, and the numeral 9 shows a terminal.

The relationship of distance l between the top end 3*c* of the top portion 3*b* and the top surface 2*a* of the insulator 2, the distance S between the side surface of the inner hole 2*c* of the insulator 2 and the side surface of the top portion 3*b* of the center electrode namely the radial width of the ring shaped space 10, the distance L between the top surface 2*a* of the insulator and the connecting position of the top portion 3*b* and the electrode body 3*a* of the center electrode namely the depth of the ring shaped space 10, and the ratio of the inner diameter D of the inner hole 2*c* of the insulator 2 and the width E of the ground electrode 4 are explained hereinafter.

Figure 4:
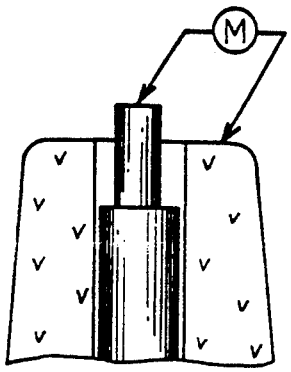
FIG. 4 is a sectional view of the spark plug explaining a detector.

The relationship described above affects the effect of anti-pollution. The effect of anti-pollution is estimated by the operation of the internal combustion engine (four cycle, 1300 cc, four cylinders, and water cooling) under such conditions that the engine is started under the atmosphere temperature of −20° C. and the radiator coolant temperature of −10° C.+1° C., raced and idled. The operation of the engine of starting, racing and idling are done within a minute. After each of the cycle of the starting, racing and idling, the resistance between the top portion 3*b* of the center electrode 3 and the top surface 2*a* of the insulator 2 is measured by the resistance detector M (shown in FIG. 4), and the anti-pollution effect is estimated by the number of the cycles until the resistance between the center electrode 3 and the ground electrode 2 becomes 1M Ω. The engine becomes hard to start and the rough idling condition when the resistance becomes 1M Ω. Since the conventional type of the spark plug which is produced by the applicant (trade code W16EX-U11) becomes 1MΩ after 10 cycles, a spark plug which is used more than 10 cycles is estimated as an effective spark plug.

Figure 6:
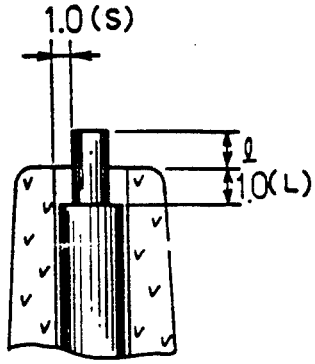
FIG. 6 is a sectional view of a spark plug which is used for the test according to the relationship described in FIG. 5.
Figure 5:
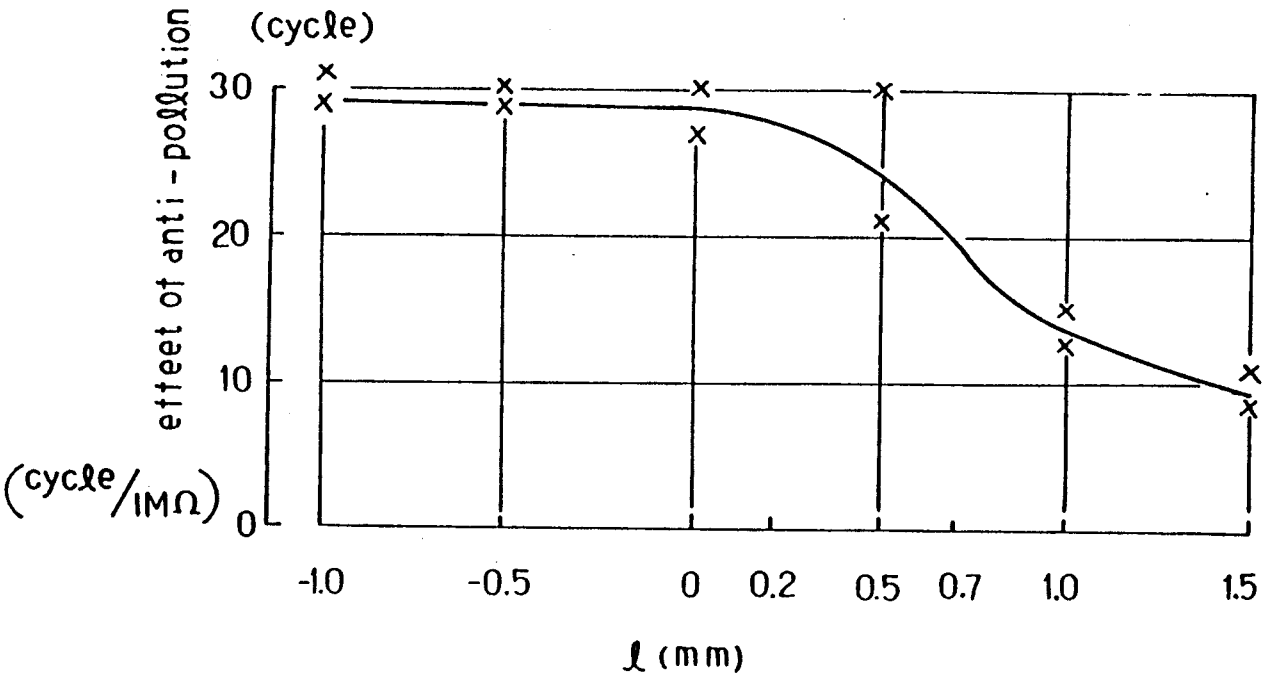
FIG. 5 shows a relationship between a distance l between the top portion of the center electrode and the top surface of the insulator and the effect of anti-pollution.

FIG. 5 shows an effect of anti-pollution by using the distance L as the parameter, the distance L is calculated as plus (+) when the top end of the center electrode 3 protrudes from the top surface of the insulator 2, and calculated as minus (−) when the top end of the center electrode is withdrawn from the top surface of the insulator 2. As shown in FIG. 6, the spark plug which is used for the test of the effect of the anti-pollution shown in FIG. 5 has a geometrical dimension that is E=D. As clearly shown from FIG. 5, the effect of anti-pollution improved when the distance l is more than 1.0 mm and less than 1.0 mm.

$$-0.1\ \text{mm} \leqq l \leqq 1.0\ \text{mm}$$

Figure 7:
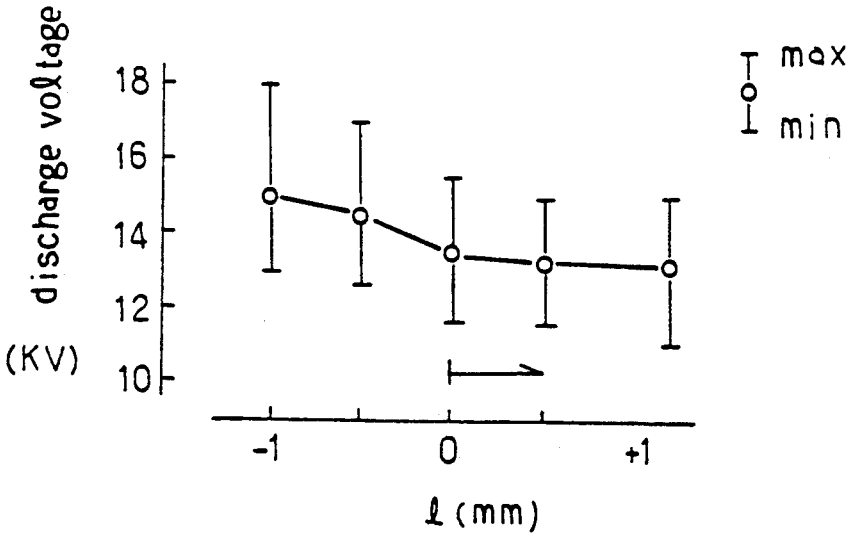
FIG. 7 shows a relationship between a position of the top surface of the insulator and the discharge voltage.

The test result of the discharge voltage by using the distance l as the parameter is shown in FIG. 7. The test shown in FIG. 7 is done under the condition of 4 gauge atmospheric pressure, and the gap G between the top end of the center electrode 3 and the side surface of the ground electrode 4 of the spark plug which is used for the test shown in FIG. 7 is fixed as 1.1 mm. As shown in FIG. 7, the discharge voltage becomes small when the distance is more than 0 mm and less than 1.0 mm.

$$0 < l \leqq 1.0\ \text{mm}$$

So that the distance which is more than 0 mm and less than 1.0 mm is preferred for improving the effect of anti-pollution and for reducing the discharge voltage.

$$0\ \text{mm} < l \leqq 1.0\ \text{mm}$$

Figure 8:
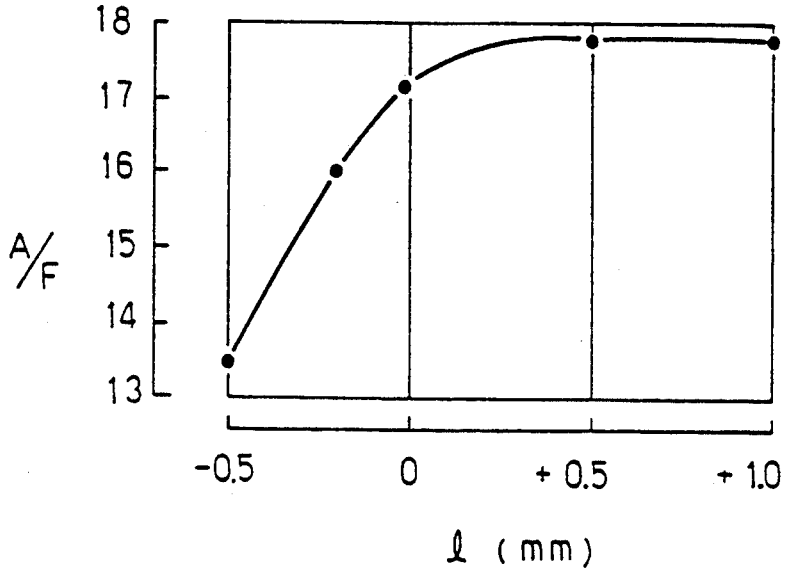
FIG. 8 shows a relationship between a position of the top surface of the insulator and an air fuel ratio.
Figure 9:
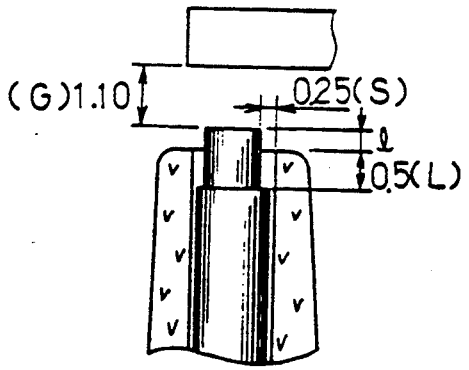
FIG. 9 is a sectional view of the spark plug which is used for the test according to the relationship shown in FIG. 8.

The igniting effect is shown in FIG. 8. The ordinate of FIG. 8 is the distance l and the coordinate of FIG. 8 is the air fuel ratio which designates an igniting effect. Namely the air fuel ratio of FIG. 8 is the leanest air-fuel ratio for igniting steady under the idling condition of the engine. The test shown in FIG. 8 is done by using the internal combustion engine (four cycle, 1600 cc, water cooling and four cylinders) under the idling condition. The air-fuel mixture flown to the engine is varied from the rich condition to the lean condition and the air-fuel ratio which is the leanest condition for operating the engine smoothly is estimated as the limit ratio. As shown in FIG. 8, the geometrical dimension of the spark plug which is used for the test shown in FIG. 8 is that E equal D. As shown in FIG. 8, it is understood that the spark plug having center electrode 3 the top end of which is extruded from the top surface of the insulator 2 can achieve the effective igniting.

As to the test result shown in FIG. 5, the effect of anti pollution is reduced when the distance l is more than 1.0 mm. According to the study of the present inventors, the ionized zone ionized by the capacitor discharge cannot be expounded toward all over the ring shaped space 10 when the difference l between the gap G and the gap g is more than 1.0 mm, so that the carbon deposited on the inner surface of the inner hole 2*c* cannot be burned out by the inductor discharge. Accordingly, the range between 0 mm and 1.0 mm of the distance l is preferred. The range between 0 mm and 0.7 mm of the distance l is more suitable from the view point of the life length of the spark plug.

Figure 10:
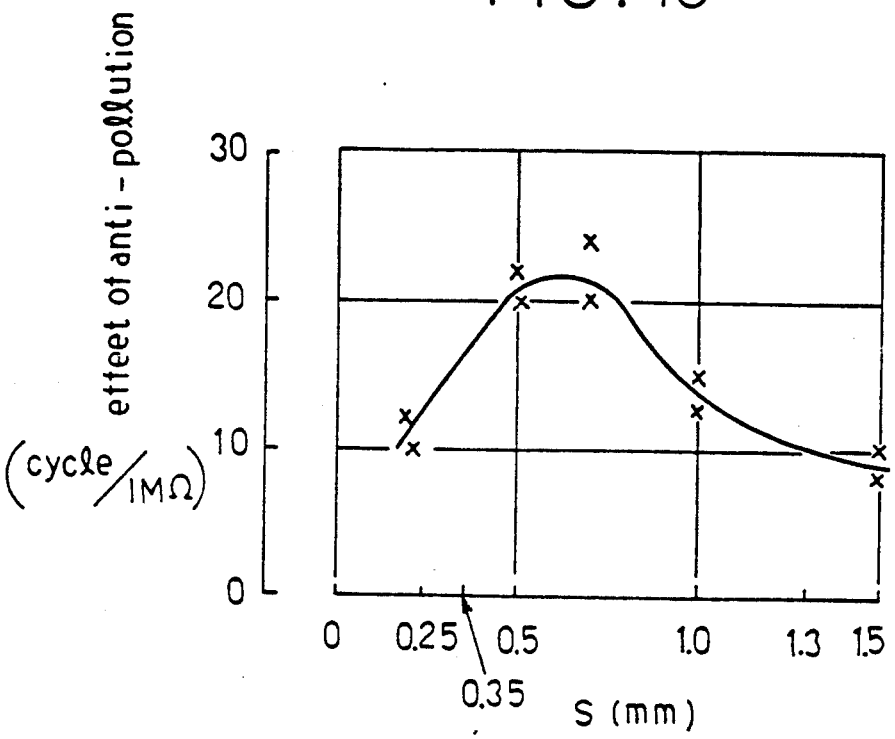
FIG. 10 shows a relationship between the distance between the side surface of the center electrode and the side surface of the insulator and the effect of anti pollution.
Figure 11:
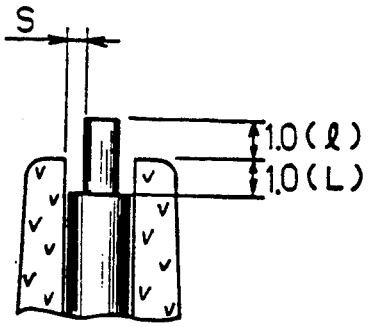
FIG. 11 is a sectional view of a spark plug which is used for the test according to the relationship shown in FIG. 10.

FIG. 10 shows the effect of anti-pollution by using the distance S as the parameter. As shown in FIG. 11, the geometrical dimension of the spark plug which is used for the test shown in FIG. 10 is that E equal D. As shown from FIG. 10, the spark plug having the distance S which is more than 0.25 mm and less than 1.3 mm can improve the effect of anti-pollution by 20%–100%.

$$0.25\ \text{mm} \leqq S \leqq 1.3\ \text{mm}$$

Since the ionized zone is limited at the top surface side of the inner hole 2*c* when the distance S is smaller than 0.25 mm, the atmosphere within the deep position of the inner hole 2*c* cannot be ionized, so that the carbon deposited on the lower side of the inner surface of the inner hole 2*c* cannot be burned out by the inductor discharge.

Since the diameter of the top portion 3*b* of the center electrode 3 becomes too narrow when the distance S is more than 1.3 mm, the top portion 3*b* may be melted during the operation of the spark plug, so that the spark plug having the distance S more than 1.3 mm cannot work effectively. The area of the inner surface of the inner hole 2*c* becomes too wide when the distance S is more 1.3 mm while the diameter of the top portion 3*b* of the center electrode 3 is kept constant, so that the total volume of the carbon deposited on the inner surface of the inner hole 2*c* becomes too much. Accordingly, the electric leak through the carbon may occur. Therefore, the distance S is preferred between 0.25 mm and 1.3 mm.

$$0.25\text{mm} \leqq S \leqq 1.3\text{mm}$$

The distance S between 0.35 mm and 1.0 mm is most suitable as shown in FIG. 10.

$$0.35 \leqq S \leqq 1.0\ \text{mm}$$

Figure 12:
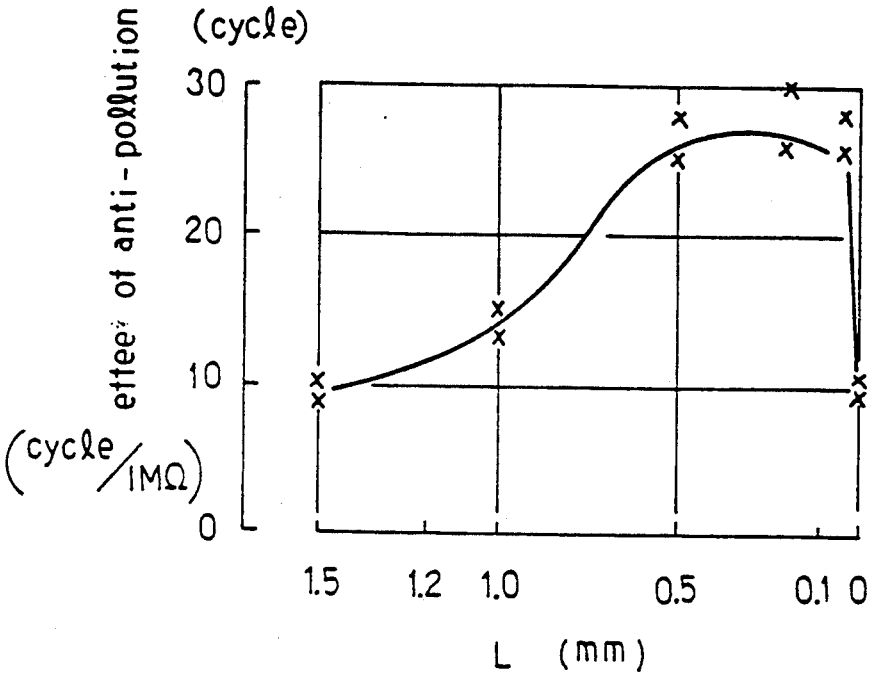
FIG. 12 shows a relationship between the depth of the ring shaped space and the effect of anti pollution.
Figure 13:
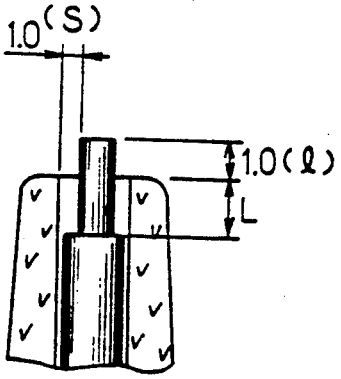
FIG. 13 is a sectional view of a spark plug which is used for the test according to the relationship shown in FIG. 12.

FIG. 12 shows the effect of anti-pollution by using the depth L of the ring shaped space 10 as the parameter. As shown in FIG. 13, the geometrical dimension of the spark plug which is used for the test shown in FIG. 12 is that E (the width of the ground electrode 4) equal D (the diameter of the inner hole of the insulator). As shown in FIG. 12, the spark plug having the depth L which is more than 0 mm and less than 1.2 mm can improve the effect of the anti pollution.

$$0 < L \leqq 1.2\ \text{mm}$$

Since the volume of the ring shaped space 10 becomes too much when the depth L is more than 1.2 mm, the volume of the carbon deposited on the inner surface of the inner hole of the insulator 2 becomes also too large, so that it should be hard for the inductor discharge to burn out every carbon deposited on the surface. The depth L is preferred between 0.1 mm and 1.0 mm as shown in FIG. 12.

$$0.1\ \text{mm} \leqq L \leqq 1.0\ \text{mm}$$

Figure 14:
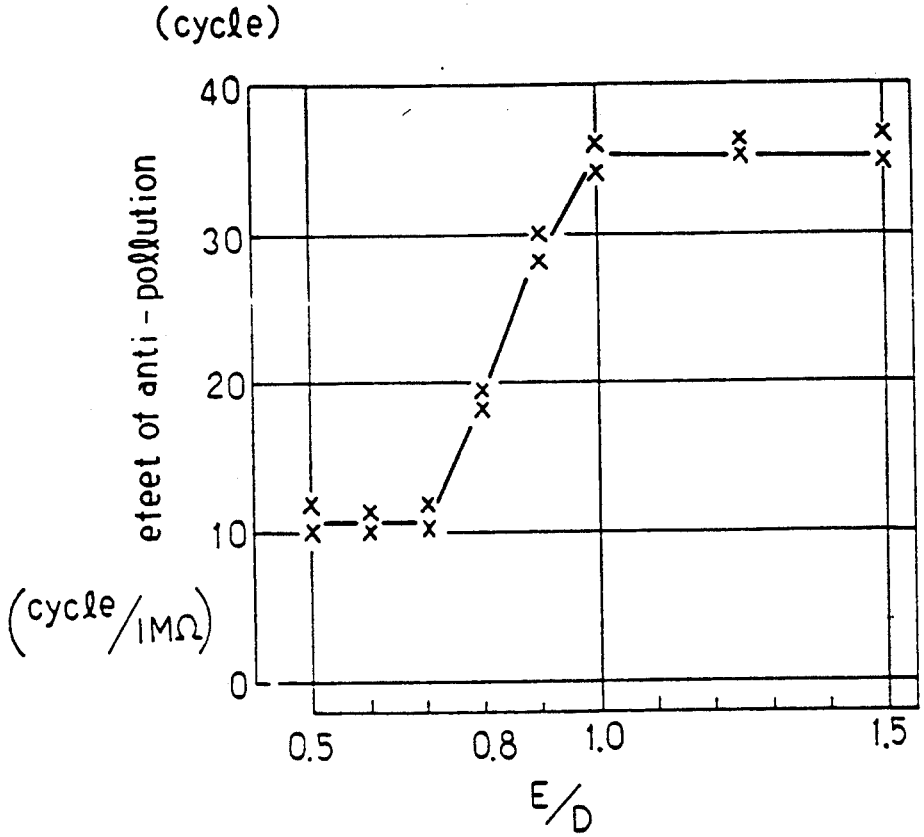
FIG. 14 shows a relationship between the ratio of the inner diameter D of the insulator and the width E of the ground electrode and the effect of anti pollution.
Figure 15:
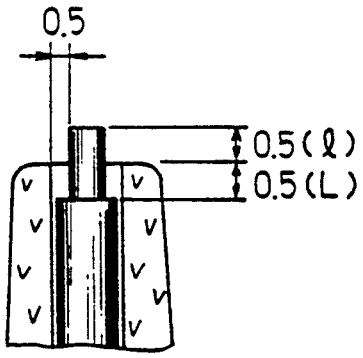
FIG. 15 is a sectional view of the spark plug which is used for the test according to the relationship shown in FIG. 14.

FIG. 14 shows the test result of the effect of anti-pollution by using the ratio between the diameter D of the inner hole of the insulator 2 and the width E of the ground electrode 4. As shown from FIG. 14, the ratio of E/D of more than 0.8 is preferred for improving the effect of anti-pollution. Even though the carbon deposited on the inner surface of the inner hole 2*c* at the upper portion thereof is burned out by the inductor discharge, the carbon deposited on the inner surface of the inner hole 2*c* at the lower side thereof which does not face to the ground electrode 4 is not burned out by the inductor discharge when the width E of the ground electrode 4 becomes too narrow. As shown from FIG. 14, the relationship between E and D is preferred.

$$E \geqq 0.8\ D\text{mm}$$

The gap G is preferred between 0.5 mm and 1.5 mm.

$$0.5\ \text{mm} \leqq G \leqq 1.5\ \text{mm}$$

The growth of the core of the flare is hindered when the gap G is less than 0.5 mm, and the discharge voltage becomes too high when the gap D is more than 1.5 mm.

Figure 16:
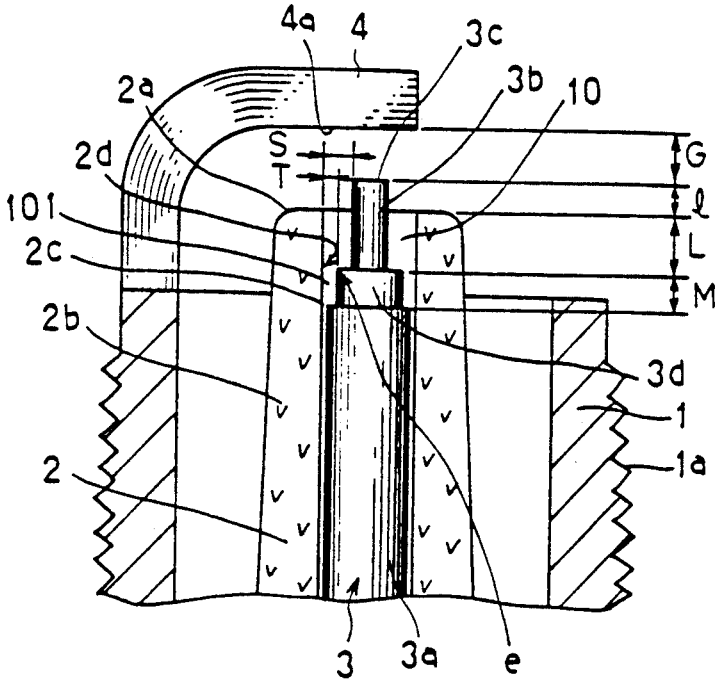
FIG. 16 is a sectional view of a spark plug according to the other embodiment cf the present invention.

The spark plug of the present invention can employ an intermediate portion 3*d* between the top portion 3*b* and the electrode body 3*a* as shown in FIG. 16. The definition of the geometrical dimension of the distance l, the distance S and the depth L of the second embodiment shown in FIG. 16 is the same as those described in FIG. 1(*b*). A second inner space 101 is formed between an outer surface of the intermediate portion 3*d* of the center electrode 3 and the inner surface 2*d* of the inner hole 2*c* of the insulator 2, the second ring shaped space 101 is connected to the ring shaped space 10 which is positioned at an upper side of the second ring shaped space 101. As can be seen from this Figure, a first edge is formed on the intermediate portion at a connection between the top portion 3*b* and intermediate portion 3*d*. This first edge is convex, the curvature of the cylinder defining the convex shape. Similarly, a second convex edge is formed between intermediate portion 3*d*, and electrode body 3. The affect of the depth M of the second ring shaped space 101 and the distance T of the second ring shaped space 101 according to the effect of anti-pollution is explained hereinafter.

Figure 17:
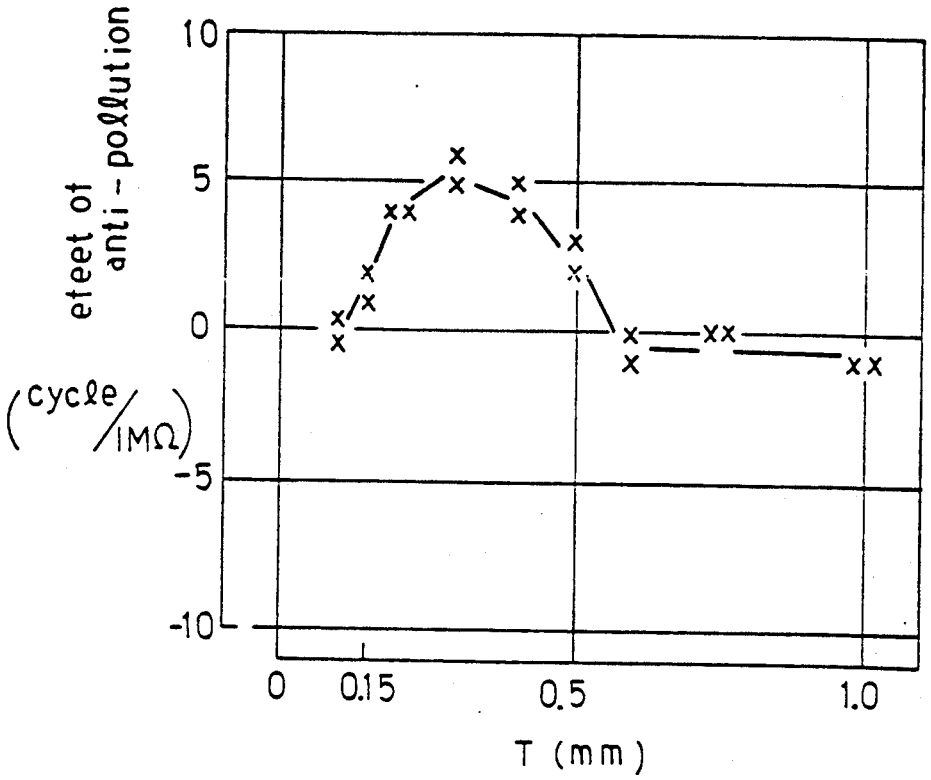
FIG. 17 shows a relationship between the distance T of the second ring shaped space and the effect of anti-pollution.
Figure 18:
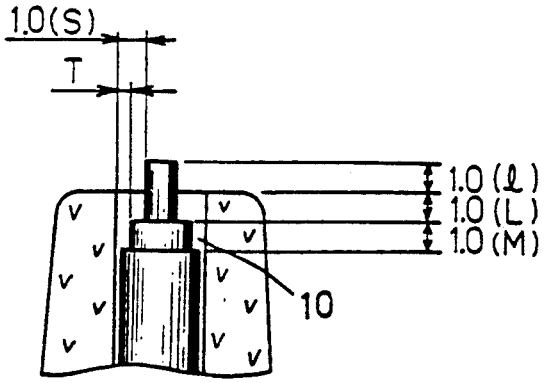
FIG. 18 is a sectional view of the spark plug which is used for the test according to the relationship shown in FIG. 17.

FIG. 17 shows the effect of anti-pollution by using the distance T as the parameter, as shown in FIG. 8, the geometrical dimension of the plug which is used for the test of FIG. 17 is that E equal D. The effect of anti-pollution shown in FIG. 18 is estimated by the difference of the effect of the spark plug having an intermediate portion 3*d* and the spark plug having no intermediate portion. In other words, coordinate of FIG. 17 is the difference of the cycles between the plugs having the second ring shaped space 101 and having no second ring shaped space. The geometrical dimensions of S, l, L, D and E are the same between the spark plug having the second ring shaped space 101 and the spark plug having no second ring shaped space. According to the test results shown in FIG. 17, the distance T is preferred between 0.15 mm and 0.5 mm.

$$0.15\ \text{mm} \leqq T \leqq 0.5\ \text{mm}$$

Figure 19:
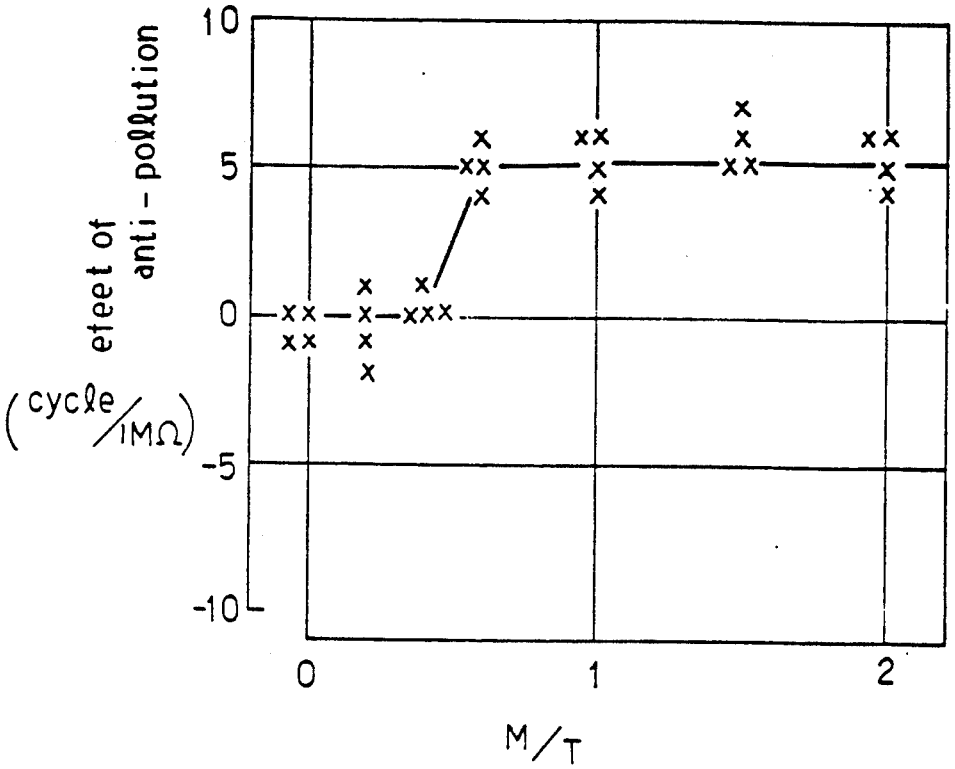
FIG. 19 shows a relationship between the ratio of the distance T and the depth M of the second ring shaped space and the effect of anti-pollution.
Figure 20:
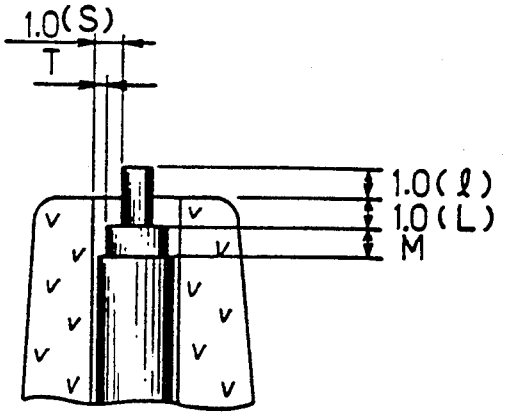
FIG. 20 is a sectional view of the spark plug which is used for the test according to the relationship shown in FIG. 19.

FIG. 10 shows the effect of anti-pollution by using the ratio between the depth M and the distance T as the parameter. The distance T of the spark plug used for the test shown in FIG. 19 is varied between 0.15 mm–0.5 mm. As shown in FIG. 19, the effect of anti-pollution can be promoted at the point that the ratio M/T is 0.5.

Since the capacitor discharge is generated not only at the gap g but also at the distance T of the second ring shaped space 101 when carbon is deposited on the inner surface 2*d* of the inner hole 2*c* of the insulator 2, the atmosphere is ionized not only by the capacitor discharge generated at the gap g but also by the capacitor discharge generated at the distance T, so that the atmosphere within the ring shaped space 10 is ionized strongly. Accordingly the capacitor discharge is intented to be generated within the ring shaped space, thereby the carbon deposited on the inner surface 2*d* of the inner hole 2*c* of the insulator 2 can be burned out more effectively. Since the gap between the outer surface of the electrode body 3*a* of the center electrode and the inner surface of the inner hole 2*c* is smaller than the distance T, the gap formed at the outside of the electrode body 3*a* is plugged by the carbon, so that the capacitor discharge is generated within the distance T. More precisely, the capacitor discharge is generated at the edge point e of the intermediate portion 3*d* of the center electrode 3.

Figure 21:
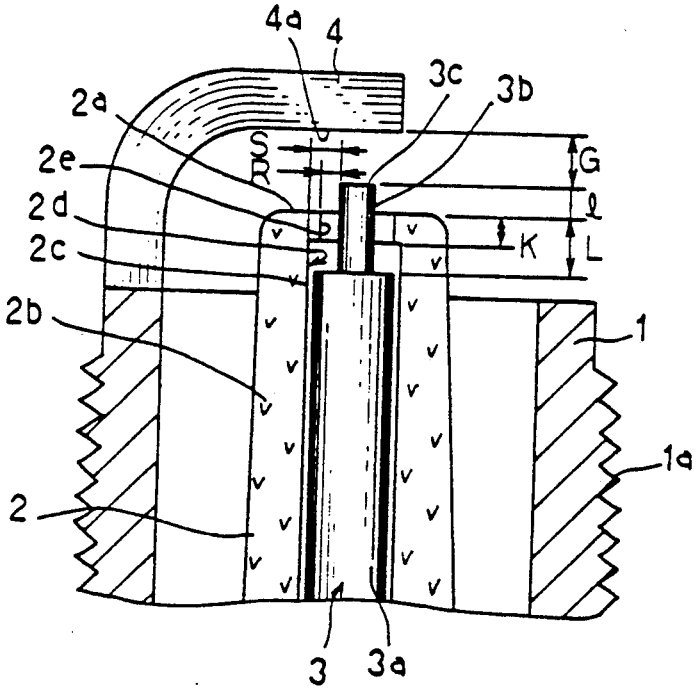
FIG. 21 is a sectional view of the spark plug of another embodiment of the present invention.

FIG. 21 shows the third embodiment of the present invention. The spark plug of the third embodiment has the insulator 2 where the top portion is bent toward the top portion 3*b* of the center electrode 3 in order to reduce the distance R of the ring shaped space 10.

Figure 22:
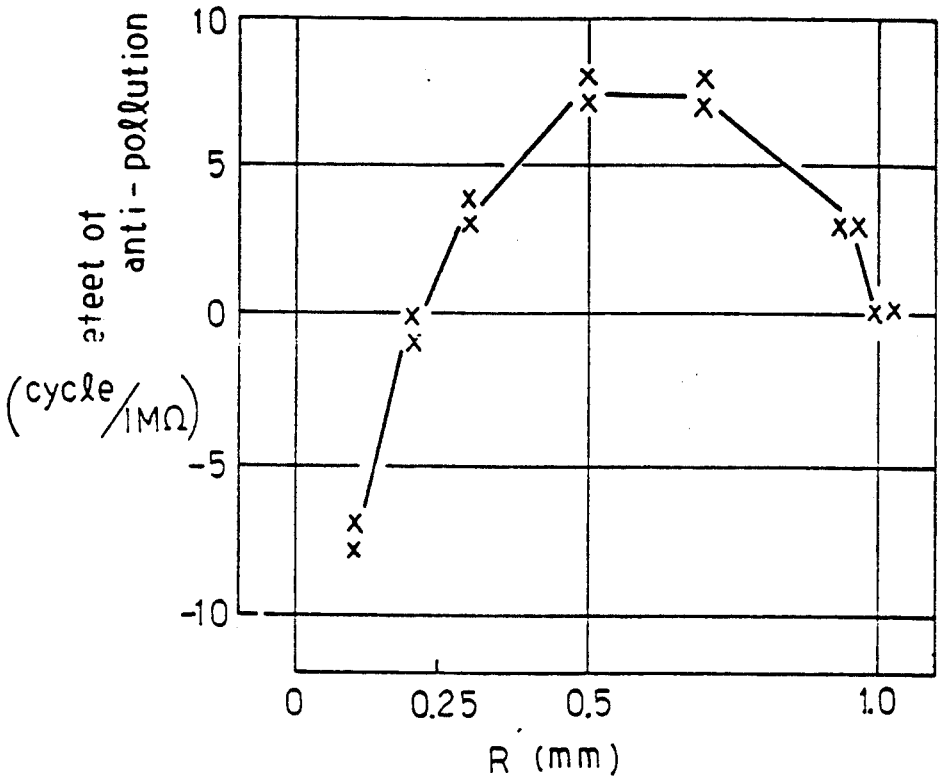
FIG. 22 shows a relationship between the distance R and the effect of anti-pollution.
Figure 23:
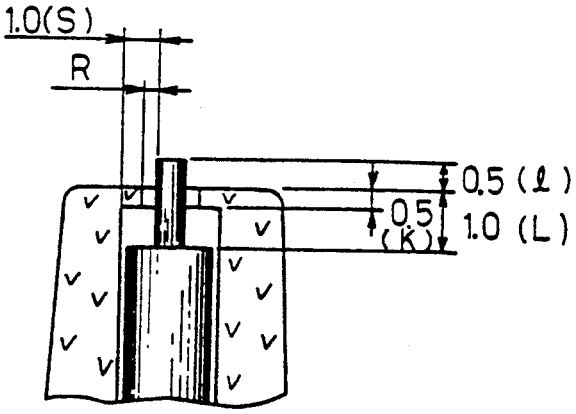
FIG. 23 is a sectional view of the spark plug which is used for the test according to the relationship shown in FIG. 22, FIGS. 24–30 are sectional views showing the other embodiments of the present invention.

FIG. 22 shows the test result of the effect of anti-pollution by using the distance R as the parameter. The coordinate of FIG. 22 is the difference of the effect between the spark plug shown in FIG. 23 and the spark plug shown in FIG. 1(*b*). The spark plug shown in FIG. 23 has the geometrical dimension of E equal D. The other dimensions of l, S and L of the spark plug shown in FIG. 23 are the same as those of the spark plug shown FIG. 1(*b*). As shown in FIG. 22, it is preferred when the distance R is more than 0.25 mm and the distance R is more than 0.05 mm shorter than the distance S.

$$0.25\ \text{mm} \leqq R \leqq S - 0.05\ \text{mm}$$

The thickness K of the protruding portion 2*e* of the insulator 2 is determined by the productive limitation. A crack is occurred at the protruding portion 2*e* when the thickness K is less than 0.1 mm. Since the coefficient of liner expansion of the center electrode 3 is larger than that of the insulator 2, the insulator 2 is expounded by heat stress when the thickness K is 0.01 mm more than the distance 0.01 mm less than the distance L.

$$0.01\ \text{mm} \leqq K \leqq L - 0.01\ \text{mm}$$

According to the spark plug shown in FIG. 21, the inductor discharge is generated along with the end surface of the protruding portion 2*e*, and the carbon deposited on the end surface of the protruding portion 2*e* is burned out effectively.

Figure 24:
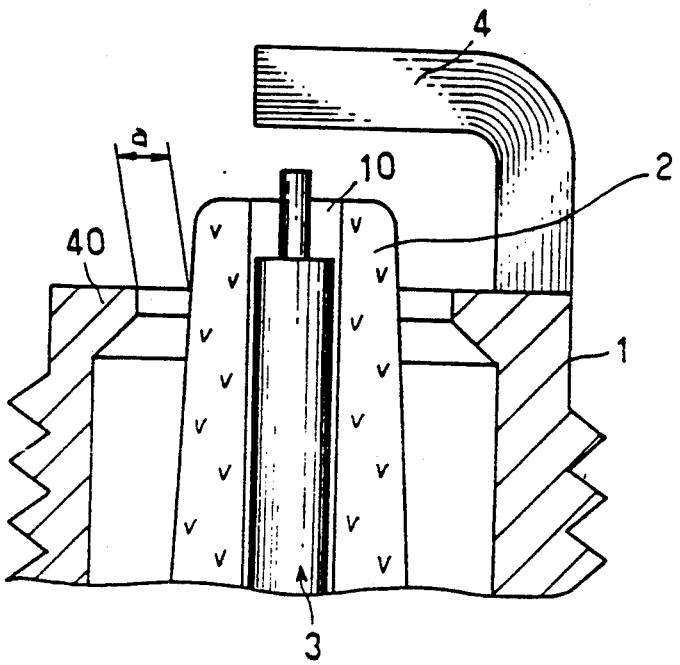

FIG. 24 shows the spark plug of the other embodiment having the housing 1 the end portion of which is bent toward the insulator 2 for forming an annular electrode 40. The gap a between the inner end surface of the annular electrode 40 and the outer surface of the insulator 2 is preferred between 0.5 mm and 1.3 mm. Since the spark plug of this embodiment has the annular electrode, the spark is generated between the insulator 2 and the, annular electrode 40 even under such special condition such as where a great volume of carbon is deposited on the inner surface of the inner hole 2*c* of the insulator 2 and the spark is not generated between the top surface 2*a* of the insulator and the ground electrode 4 and between the top end 3*c* of the center electrode 3 and the ground electrode 4. The internal combustion engine can continue to work by the spark generated between the annular electrode 40 and the insulator 2, because the flare generated by the inductor discharge at the gap a can burn the carbon deposited on the inner surface of the inner hole 2*c* of the insulator 2 out.

Figure 25:
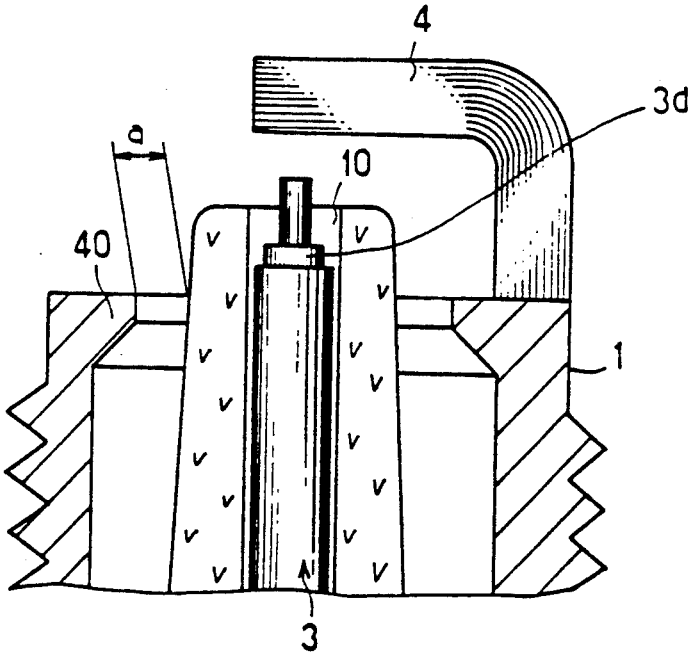
Figure 26:
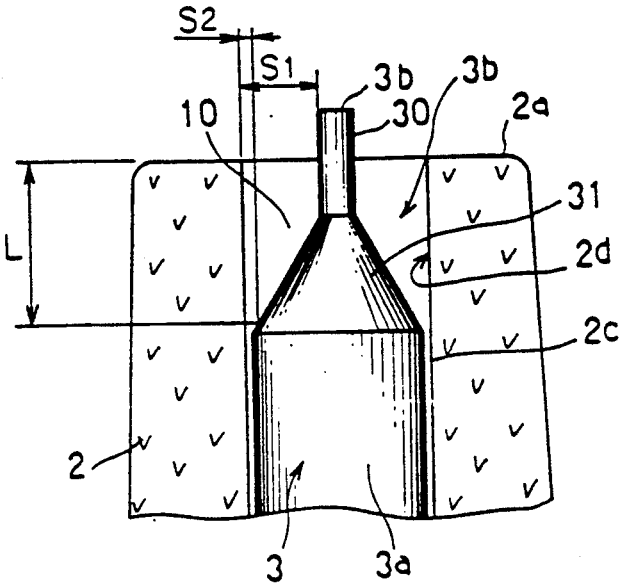

As shown in FIG. 25, the spark plug of the present invention can employ the annular electrode 40 and intermediate portion 3*d*. The intermediate portion 3*d* of the present invention can be modulated to be corn shaped such as shown in FIG. 26. The gap S between the corn shaped intermediate portion 31 and the inner surface of the inner surface 2*d* of the inner hole 2*c* of the insulator 2 is varied between the minimized gap $S_2$ and the maximized gap $S_1$.

Figure 27:
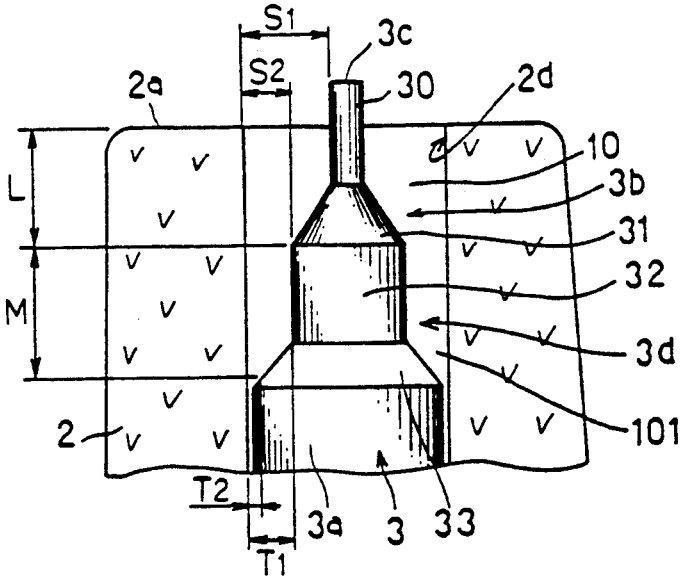

The intermediate portion of the center electrode 3 of the present invention can be modulated as the shape shown in FIG. 27, namely a straight portion 32 and a taper portion 31 form intermediate portion 3*d*. The gap between the inner surface 2*d* of the inner hole 2*c* of the insulator and the outer surface of the intermediate portion 3*d* is also varied between the minimized gap $S_2$ and the maximized $S_1$. Furthermore, since the taper portion 33 is formed between the straight portion 32 and the electrode body 3*a* , the gap T between the inner surface 2*d* of the inner hole and the outer surface of the electrode body 3*a* is also varied from the maximum gap $T_2$ to the maximized gap $T_1$. The gap S and the gap T is preferred between 0.25 mm and 1.3 mm and 0.15 mm and 0.5 mm, respectively.

$$0.25\ \text{mm} \leqq S \leqq 1.3\ \text{mm}$$

0.15 mm≦T≦0.5 mm

Figure 28:
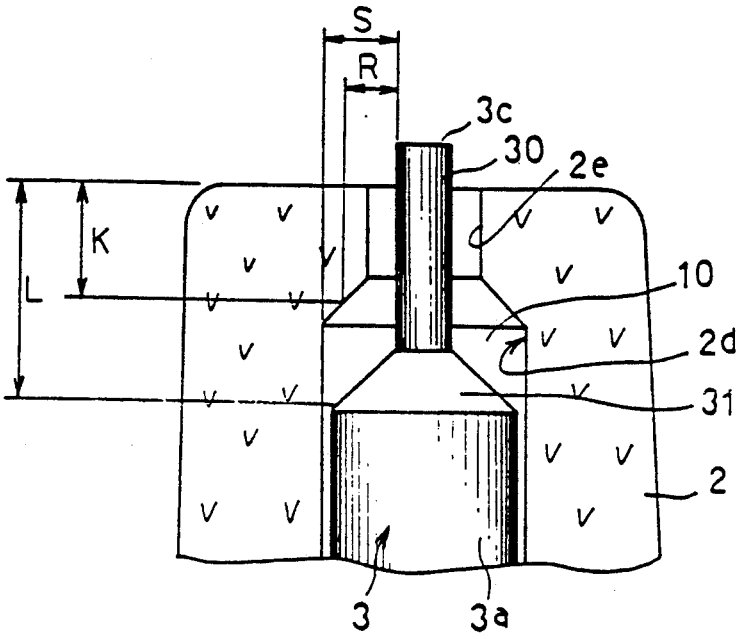
Figure 29:
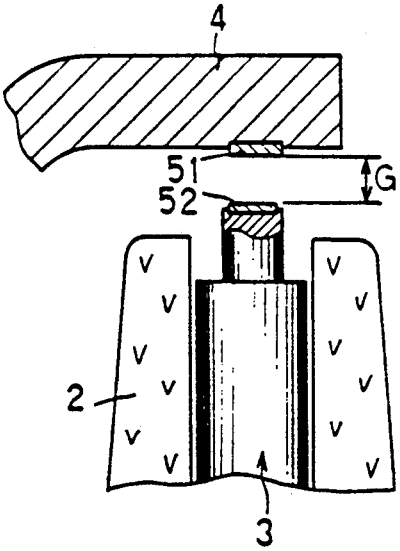
Figure 30:
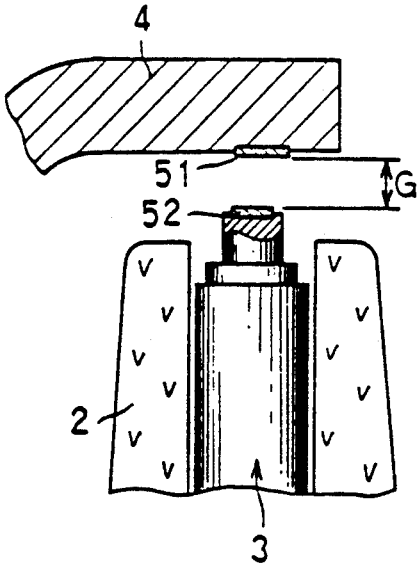

FIG. 28 shows another embodiment of the present invention, the tapered wall is formed between the protruding portion 2*e* and the inner surface 2*d* of the inner hole 2*c* and the tapered wall 31 is also formed between the top portion 2*b* and the electrode body 3*a* of the center electrode 3. FIGS. 29 and 30 show further embodiments of the present invention. The noble metal 51 and 52 such as platinum alloy are welded to the center electrode 3 and the ground electrode 4 in order to prolong the life length of the spark plug. Even though the platinum alloys 51 and 52 are provided to the spark plug shown in FIGS. 29 and 30 which are the equivalents of the spark plugs shown in FIG. 1(*b*) and FIG. 16 respectively, any other types of the spark plug such as shown in FIGS. 21, 26–28 can fitted with the platinum alloy on the center electrode 3 and the ground electrode 4.

As described above, the spark plug of the present invention can attain the effective advantages.

(1) Since the geometrical dimensions of l, S and L of the spark plug is determined under the conception described above, the spark can be generated effectively at the gap g and the ring shaped space even though the insulator is deposited on the inner surface of the inner hole of carbon and even though the gap g between the top surface of the insulator and the side surface of the ground electrode is larger than the gap G between the top end of the center electrode and the side surface of the ground electrode. Accordingly, the spark plug of the present invention can burn the carbon deposited on the inner surface of the inner hole of the insulator out and can grow the core of the flare generated at the gap g for improving the igniting effect.

(2) Since the spark plug according to the present invention has the second ring shaped space between the top portion of the center electrode and the inner surface of the inner hole of the insulator in such a manner that the second ring shaped space is positioned behind the ring shaped position and that the distance of the second ring shaped space is smaller than the distance of the ring shaped space, the spark can be generated within both of the ring shaped space and the second ring shaped space, so that the carbon deposited on the inner surface of the inner hole can be burned out more effectively.

(3) Since the spark plug according to the present invention employs the ring shaped space, the opening portion of which is throttled, the spark generated within the ring shaped space elongates along the end surface of the protruding portion of the insulator, so that the carbon deposited on the protruding portion can be burned out effectively.

(4) Since the spark plug according to the present invention employs an annular electrode at an inner surface of the housing which faces toward the insulator via the gap, the spark can be generated at the gap even though much volume of carbon is deposited within the ring shaped space between the center electrode and the insulator, so that the flare generated by the spark at the gap can burns the carbon deposited within the ring shaped space out and that the internal combustion engine can be ignited by the flare generated by the spark at the gap.

(5) Since the spark plug according to the present invention employs the noble metal welded on the electrodes, the life length of the spark plug can be prolonged.

What is claimed is:

1. A spark plug for an internal combustion engine comprising:

an insulator having an inner hole elongated along a longitudinal axis thereof, said inner hole opening at a top surface of said insulator, a housing provided within said inner hole of said insulator, and having a center electrode having an electrode body and an intermediate portion, a diameter of which is smaller than a diameter of said electrode body, and a top portion, a diameter of which is smaller than a diameter of said intermediate portion to form stepped portions of decreasing diameter;

wherein a top end of said top portion is extruded from said top surface of said insulator, and said intermediate portion between said top portion and said electrode body is positioned within said inner hole of said insulator, a first ring-shaped space is formed between an inner surface of said inner hole of said insulator and an outer surface of said top portion, a width of said first ring-shaped space being sized so that a capacitor discharge may occur when a certain amount of carbon is deposited on said inner surface of said inner hole, a second ring-shaped space is formed between an inner surface of said inner hole of said insulator and an outer surface of said intermediate portion, a width of said second ring-shaped space being sized so that a capacitor discharge may occur when a certain amount of carbon is deposited on said inner hole of said insulator, a first edge which is convex when viewed from a top planar view and is formed by an upper edge of said intermediate portion at said stepped portion between said top portion and said intermediate portion, and a second convex edge being formed at a connection portion of said intermediate portion and said electrode body.

2. A spark plug claimed in claim 1 wherein said top portion of said center electrode includes a cone shaped portion provided between a straight portion of said top portion an said intermediate portion.

3. A spark plug claimed in claim 1 wherein said top portion of said center electrode includes a cone shaped portion provided between a straight portion of said top portion and said intermediate portion.

4. A spark plug claimed in claim 1 wherein said intermediate portion of said center electrode includes a cone shaped portion provided between a straight portion of said intermediate portion and said electrode body.

5. A spark plug claimed in claim 1, wherein outer surfaces of said electrode body, intermediate portion, and top portion are parallel with one another, so that said convex edges are substantially 90 degree edges.

6. A spark plug for an internal combustional engine claimed in claim 1 further comprising a piece of noble metal which is provided on said center electrode.

7. A spark plug for an internal combustional engine comprising:

a center electrode, an insulator having an inner hole in which said center electrode is disposed, a metal housing provided at an outer surface of said insulator, and a ground electrode connected to said housing;

a top portion of said center electrodes further including:

an intermediate portion between said top end and an electrode body of said center electrode, a first ring shaped space formed between said inner surface of said inner hole of said insulator and an outer surface of said top portion, a diameter of said intermediate portion being smaller than a diameter of said electrode body and larger than a diameter of said top portion at said top end so that a second ring shaped space is formed behind said ring shaped space between said inner surface of said inner hole of said insulator and an outer surface of said intermediate portion, wherein said inner wall of said inner hole of said insulator at said top surface side protrudes toward said top portion of said center electrodes toward said top portion of said center electrodes so that a radial distance of said ring-shaped space at an opening end is throttled.

* * * * *